US005705212A

United States Patent [19]

Atkinson

[11] Patent Number: 5,705,212

[45] Date of Patent: Jan. 6, 1998

[54] FOOD PACKAGE WITH AN ENCLOSED EATING UTENSIL

[76] Inventor: Patrick J. Atkinson, 519 N. Raymond St., Bismarck, N. Dak. 58501

[21] Appl. No.: 524,657

[22] Filed: Sep. 8, 1995

[51] Int. Cl.[6] ..... B65D 43/10; B65D 51/24

[52] U.S. Cl. ..... 426/115; 426/124; 220/212; 206/542; 30/324

[58] Field of Search ..... 206/541, 542; 220/574.1, 212, 212.5, 735, 762, 765, 758; 426/115, 124; 30/322–328, 148–150, 47

[56] References Cited

U.S. PATENT DOCUMENTS

| | | | |
|---|---|---|---|
| 403,656 | 5/1889 | Gerstle | 220/762 |
| 874,701 | 12/1907 | O'Neill . | |
| 1,514,379 | 11/1924 | Fleischer | 426/115 |
| 1,607,865 | 11/1926 | Butler | 206/542 |
| 2,401,534 | 6/1946 | Welch | 30/324 |
| 2,604,976 | 7/1952 | Sarg | 206/541 |
| 2,766,796 | 10/1956 | Tupper | 426/115 |
| 2,812,577 | 11/1957 | Leibow | 30/324 |
| 3,550,805 | 12/1970 | Leonforte | 220/212 |
| 3,624,787 | 11/1971 | Newman | 220/212 |
| 3,679,093 | 7/1972 | Chang | 206/542 |
| 4,216,875 | 8/1980 | Stanish | 220/212 |
| 4,219,283 | 8/1980 | Buckley | 401/129 |
| 4,233,325 | 11/1980 | Slangan et al. | 426/115 |
| 4,539,749 | 9/1985 | Woon | 30/344 |
| 4,589,204 | 5/1986 | Vogel | 30/324 |
| 4,615,120 | 10/1986 | Newman | 30/324 |
| 4,788,862 | 12/1988 | Fuller | 30/324 |
| 4,826,033 | 5/1989 | Satoh | 30/324 |
| 4,930,637 | 6/1990 | DeRoseau | 206/541 |
| 4,990,345 | 2/1991 | Webb | 220/212 |
| 5,058,279 | 10/1991 | Mars | 30/327 |
| 5,090,572 | 2/1992 | DeRoseau | 206/542 |
| 5,251,758 | 10/1993 | Kolacek | 206/542 |
| 5,415,309 | 5/1995 | Wang | 220/212 |
| 5,447,236 | 9/1995 | Perry et al. | 206/541 |
| 5,479,708 | 1/1996 | Thomas | 30/324 |

FOREIGN PATENT DOCUMENTS

| | | | |
|---|---|---|---|
| 2673606 | 9/1992 | France | 426/115 |
| 3521289 | 12/1985 | Germany | 206/542 |
| 1349332 | 4/1974 | United Kingdom | 426/115 |

*Primary Examiner*—Steven Weinstein
*Attorney, Agent, or Firm*—James V. Harmon

[57] ABSTRACT

A food package that includes a concealed eating utensil is provided. The package comprises a can body containing a quantity of food with a cover removably secured to the can to enclose one end of the can and to provide a storage compartment between the end of the can and the cover. A folded eating utensil is contained in the storage compartment. The utensil has two portions: a functional end portion (spoon, fork or knife) and a handle portion with a joint between them for enabling the utensil to be folded for storage in the compartment. The term "joint" is used broadly herein to include any form of connection, e.g., a hinge or complete separation of the handle from the functional end portion of the utensil with a socket connection therebetween. Utensil retaining members can be provided inside the cover for engaging portions of the utensil to hold it in place.

11 Claims, 5 Drawing Sheets

FOOD PACKAGE WITH AN ENCLOSED EATING UTENSIL

FIELD OF THE INVENTION

This invention relates to food containers and packaging, and more particularly to a food package with an enclosed eating utensil.

BACKGROUND OF THE INVENTION

While it has been previously proposed to mount a utensil in a container, there has been no satisfactory way of providing a concealed utensil such as a spoon that is larger than the container itself so as to enable the food to be conveniently removed from the container and yet allow the utensil to be easily collapsed and placed back in storage for later use. U.S. Pat. No. 4,219,283, for example, describes a bottle having a removable cap with a vertical extension that has a brush or spoon at its free end for removing granular material from the bottle. However, when the cap is placed back on the bottle, the brush or spoon extends completely into the compartment contacting the granules or fingernail polish stored therein. In addition, the utensil is connected rigidly to the cap so that it can not be used separately. The device is also unsatisfactory for food use, primarily from a food safety standpoint but also from an aesthetic point of view because the spoon touches the contents of the bottle.

In view of these and other deficiencies of the prior art, it is a primary object of the present invention to provide a way of compactly storing an eating utensil in a concealed compartment within a food package but out of contact with the food.

Another object is to provide a concealed utensil that is larger than a container in which it is placed and includes a joint which allows the utensil to be assembled for eating the food, but also allows it to be collapsed before use and held securely in place within the food package during shipment and storage.

A further object is to provide an improved food package that has a concealed utensil, e.g., a spoon or fork, which is securely retained in a concealed compartment within the food package, and can later be placed back in the compartment after being used and stored in that location where it is kept clean for reuse later on.

These and other more detailed and specific objects of the present invention will be better understood by reference to the following figures and detailed description which illustrate by way of example but a few of the various forms of the invention within the scope of the appended claims.

SUMMARY OF THE INVENTION

The present invention provides a food package that includes a concealed eating utensil. The food package comprises a can body containing a quantity of food. A cover is removably secured to the can to enclose one end of the can and to provide a storage compartment between the end of the can and the cover. A folded eating utensil is contained in the storage compartment. Utensil retaining members are preferably but not essentially provided inside the cover for engaging portions of the utensil to hold it in place, i.e., attached to the cover. While the utensil can be loose inside the compartment, it is preferably attached to the cover. The utensil has two portions: first, a functional end portion (spoon, fork or knife) and second, a handle portion with a joint between them that enables the utensil to be folded up for storage in the compartment. The term "joint" is used broadly herein to include any form of connection, e.g., a complete separation of the handle from the functional end portion of the utensil with a socket connection therebetween. However, a hinged connection is greatly preferred to provide greater strength and convenience.

THE FIGURES

DETAILED DESCRIPTION OF THE INVENTION

Figure 1:
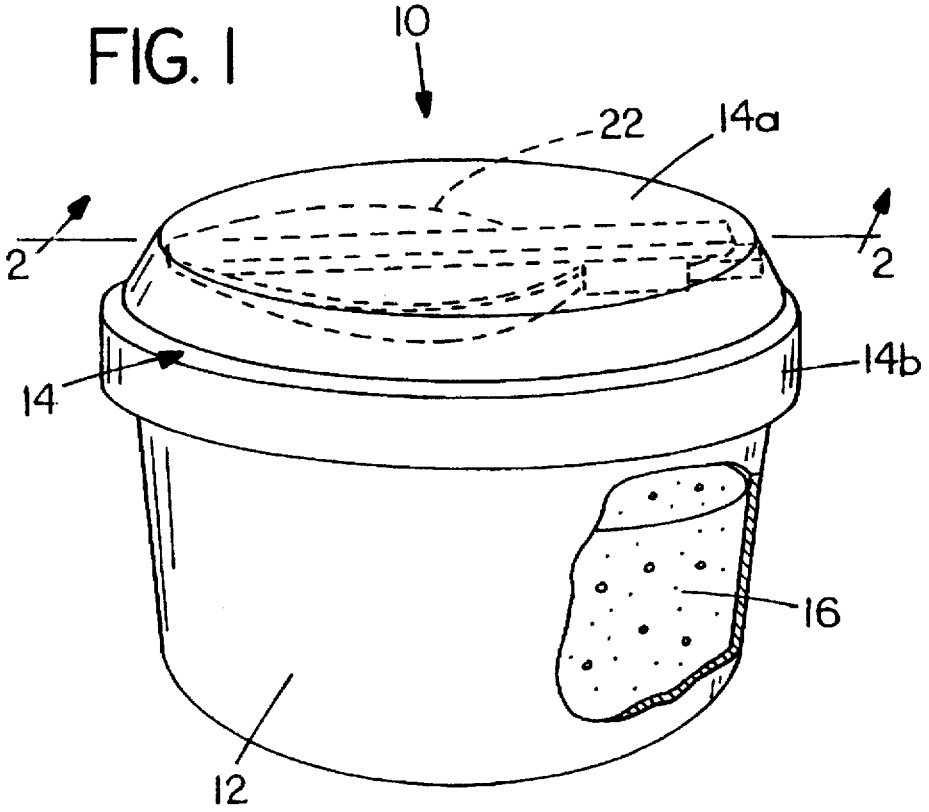
FIG. 1 is a perspective view of the package as it appears in an assembled condition when sold.
Figure 2:
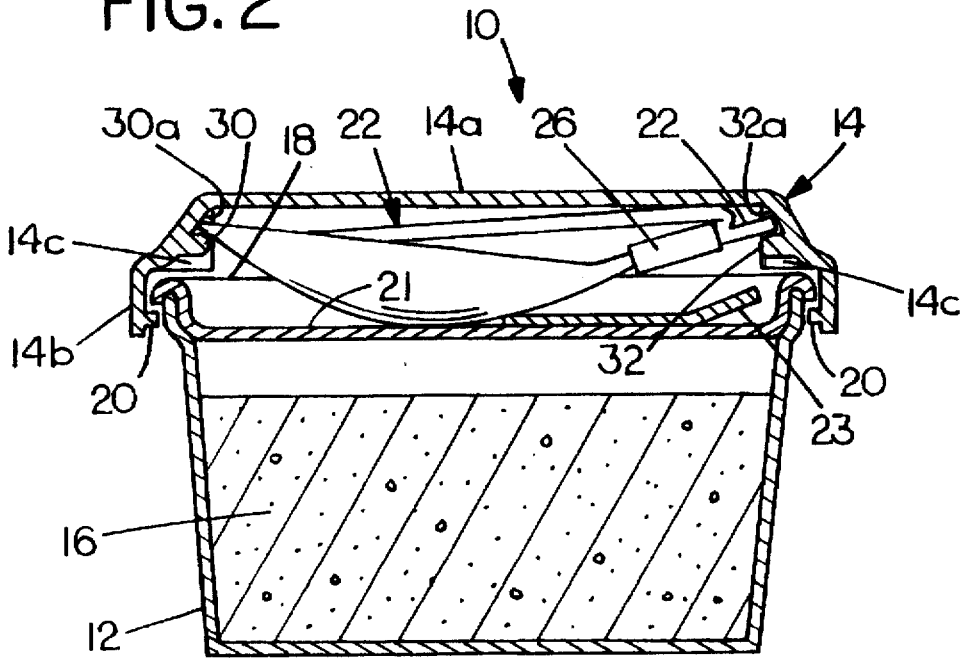
FIG. 2 is an enlarged vertical cross-sectional view taken on line 2—2 of FIG. 1.

As shown in FIGS. 1 and 2, the invention provides a food package 10 including a can body 12 having side, top and bottom walls. Removably secured to the top of can body 12 is a cover 14 that can be formed from flexible plastic resin, e.g., polyethylene. The cover 14 encloses a hollow space or storage compartment 15 for a collapsible eating utensil 22. Utensil 22 can be formed from any suitable plastic, preferably a soft plastic that will provide a strong living hinge 22*c*.

Inside the can body 12 is a food product 16, e.g., a ready-to-eat food such as cooked vegetables, a casserole, a cooked meat product or any of a variety of convenience foods such as pudding, gelatin desserts, office snacks, convenience lunch products, ice cream, frozen desserts, or a beverage. The invention can be used in a wide variety of applications, e.g., for bikers, military use, schools, camping, fast food outlets, for main courses, snacks, or desserts such as yogurt, etc.

The top of the can body 12 terminates in an upper horizontally disposed circular bead or rim 18. Extending horizontally just inside the rim 18 is a removable lid 21 formed, for example, from a thin sheet of aluminum. The lid 21 provides a hermetic seal to prevent contamination of the food. A handle or tab 23 can be provided on the lid 21 to enable the lid 21 to be fractured and torn away from the top of the container to expose a food product 16. The storage space or compartment 15 for the utensil 22 is located between horizontal top wall 14*a* of the cover and the removable lid 21.

The cover 14 includes a circular horizontal top wall 14*a* and a circular downwardly extending side wall 14*b* with a centrally projecting internal circular rib 20 that snaps over the rim 18 of the can body 12 to hold the cover 14 in place on the can body 12 so that it can be easily removed and replaced whenever desired. To this end, the cover 14 is formed from a flexible plastic of which polyethylene and polypropylene are examples. The inside of the cover 14 is also provided with integral centrally and downwardly projecting spacers 14c to keep the cover 14 in the proper position on top of the can body 12 by engaging the top of the rim 18.

Before use, the utensil 22 is held securely inside the cover 14 by providing the cover 14 with utensil retaining slots 30a and 32a, respectively, just above a pair of diametrically opposed centrally projecting retaining lugs 30 and 32 that extend centrally from the side wall 14b of the cover 14. The utensil 22 can be slid into place within the slots 30a, 32a from one side or, if desired, can be sized to snap into the slots 30a, 32a. If desired, the lugs 30, 32 and corresponding slots 30a, 32a are eliminated. In this case, the utensil 22 is dimensioned to fit snugly within the compartment 15 and is "loose" therein. This modification, however, provides no secure support for the utensil 22 and also increases the chance of its being inadvertently misplaced.

Figure 3:
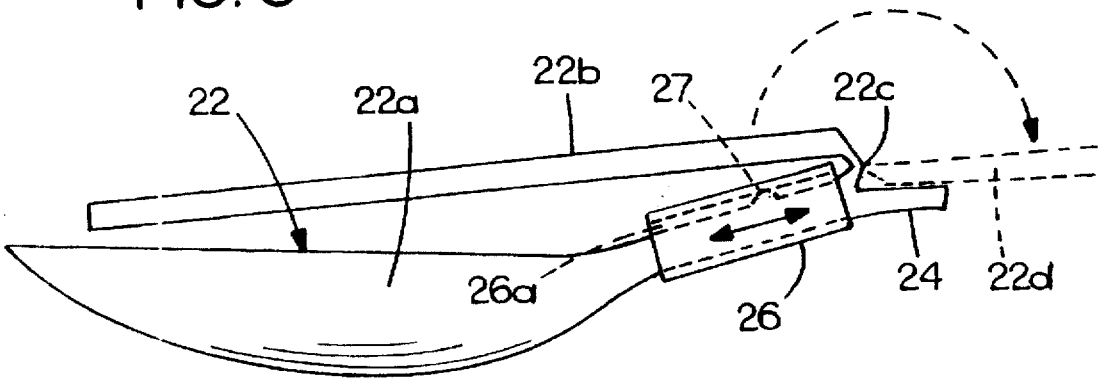
FIG. 3 is a greatly enlarged side view of the utensil in a folded condition for storage within the package.
Figure 4:
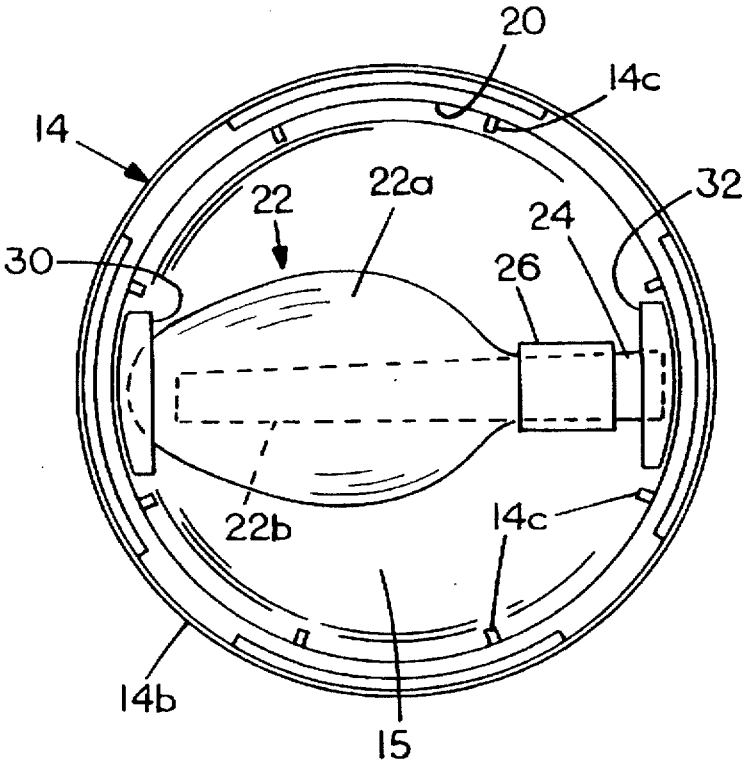
FIG. 4 is a bottom view of the cover of the package with the utensil located in a stored position within the cover as it appears prior to use.
Figure 5:
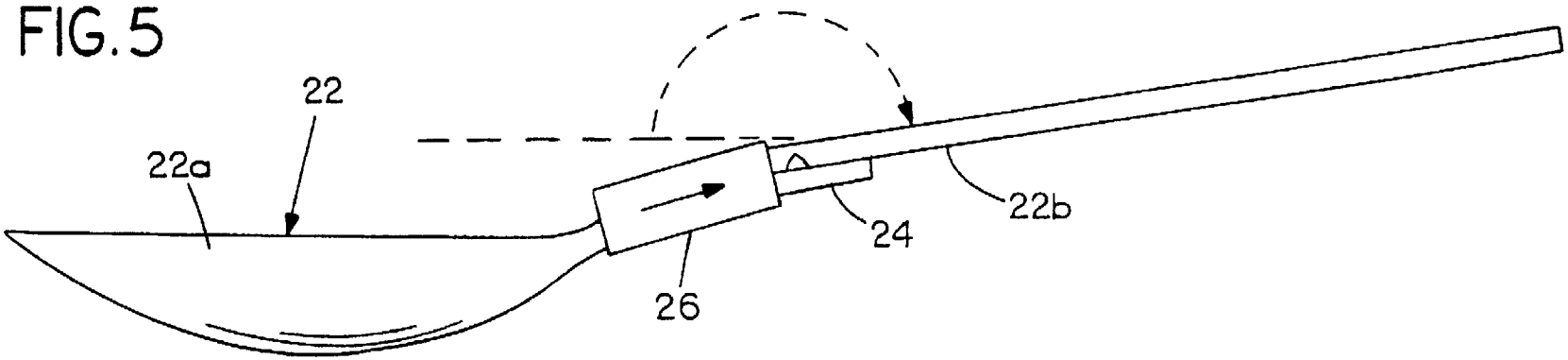
FIG. 5 is a side view of the utensil as it appears when it is being unfolded for use.
Figure 6:
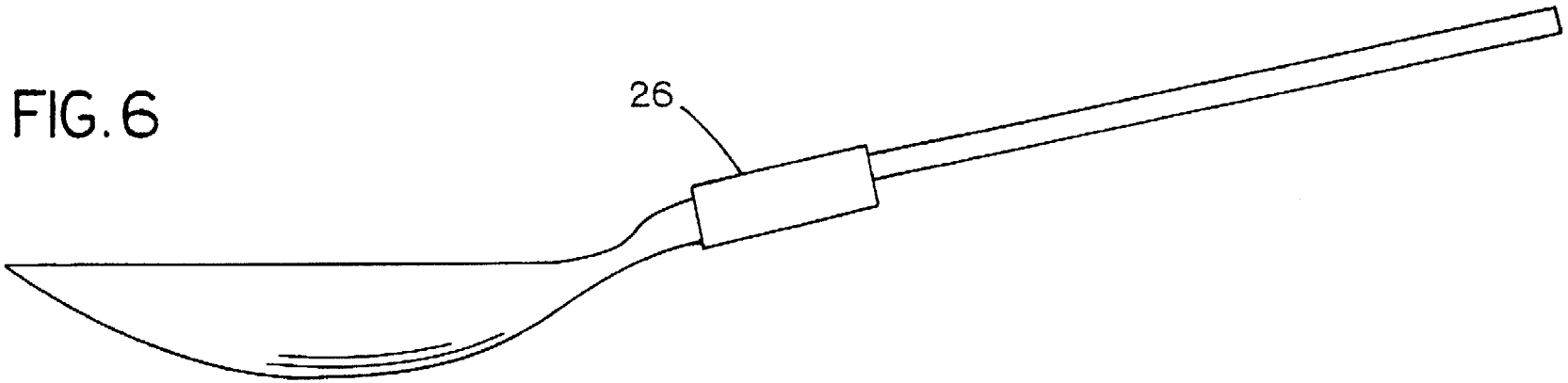
FIG. 6 is a side view of the utensil ready for use with the handle in an unfolded, i.e., extended, position
Figure 7:
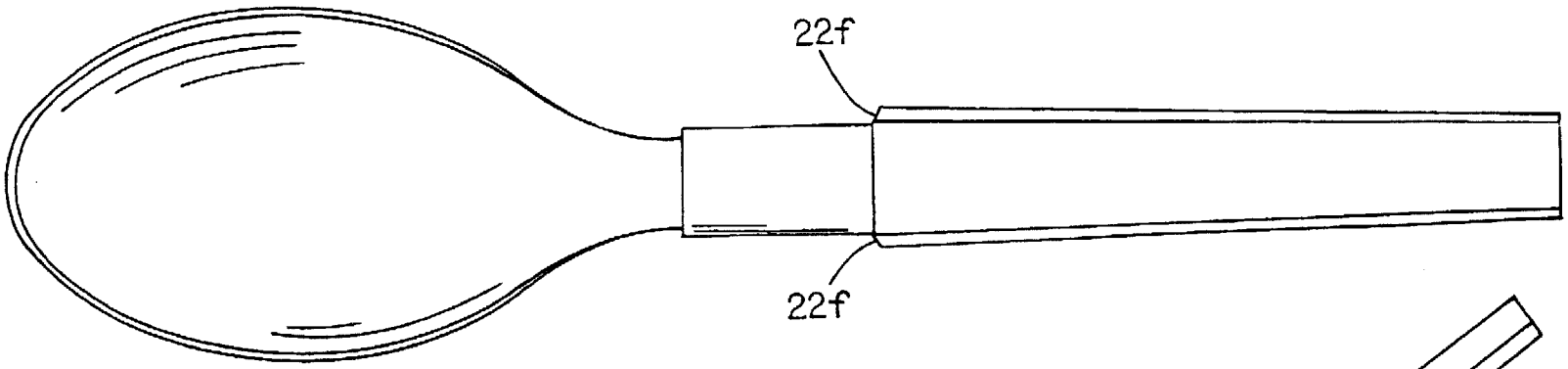
FIG. 7 is a top view of the utensil of FIG. 6.

Refer now to FIGS. 3–7. The utensil 22, which in this case is a spoon, has a functional end or spoon portion 22a connected to a handle portion 22b by means of a joint, e.g., in this case a living hinge 22c which enables the handle portion 22b to be folded to a collapsed position as shown in FIGS. 2–4 adjacent to and immediately above the spoon portion 22a. The spoon portion 22a of the utensil 22 also includes a stop or abutment 24 against which the handle portion 22b comes to rest as shown at 22d in FIG. 3 when the handle portion 22b is unfolded. The abutment 24 is provided with a free end (at the right in the figures) and a base or connected end 24a adjacent to the living hinge 22c. Once the handle 22b is unfolded, a locking sleeve 26 having an internal passage 26a from one end to the other can be slid longitudinally (toward the right in this case) from the position of FIGS. 2–6 to the locking position shown in FIGS. 7 and 8. The locking sleeve 26 also strengthens the utensil 22 adjacent the living hinge 22c. Adjacent to the hinge 22c and located within the locking sleeve 26 is a tension bump 27 that is integral with and projects upwardly from the upper surface of the utensil 22. The tension bump 27 increases the friction between the locking sleeve 26 and the spoon when the locking sleeve is slid into position for use as shown in FIGS. 6 and 7, thereby reliably holding it in place. The abutment 24 has a dual purpose. First, it provides a firm support for the handle 22b and helps to establish its position so as to hold it securely in place when the handle is extended. In addition, the abutment 24 extends into and securely holds the utensil 22 in the retaining slot 32a.

During shipment and storage, the utensil 22 is stored in a concealed position and is reliably attached to the inside of the cover 14. This keeps the utensil 22 clean prior to use. When the food 16 is to be consumed, the consumer simply removes the cover 14, tears off the lid 21, and then snaps the utensil 22 out of its concealed position in the inside of the cover 14, unfolds the utensil 22 and slides the locking sleeve 26 up the neck of the utensil toward the handle portion 22b until it strikes stops 22f (FIG. 7). The tension bump 27 holds the locking sleeve 26 in place while the utensil is used for eating the food 16. If the consumer wishes to do so, the locking sleeve 26 can be slid back to its original position, allowing the utensil 22 to be folded up and replaced in the holder on the inside of the cover 14. The cover can then be replaced on the can body 12 in the position shown in FIGS. 1 and 2, thereby keeping the utensil 22 clean until the consumer wishes to finish eating the food 16.

Figure 8:
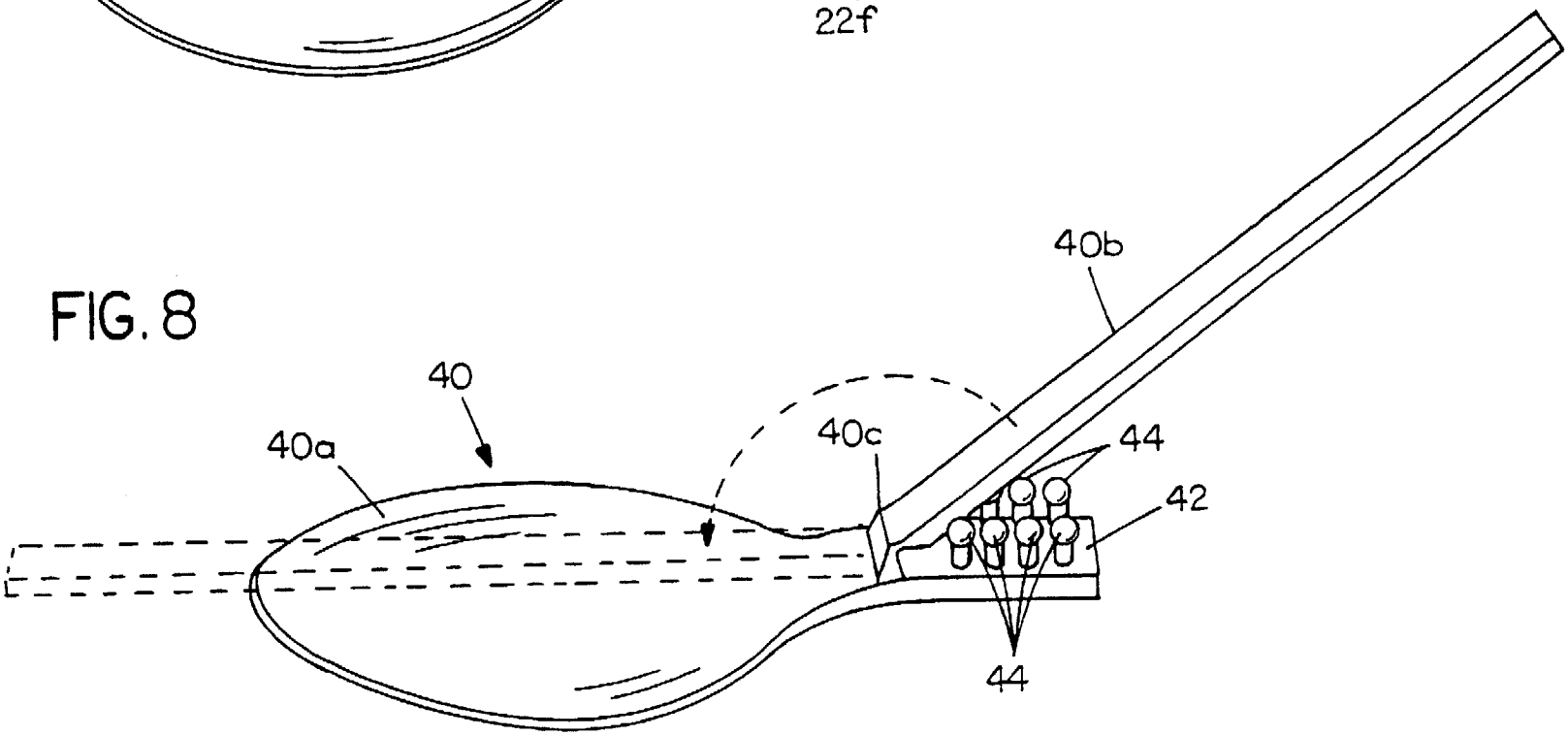
FIG. 8 is a perspective view of another form of utensil.
Figure 9:
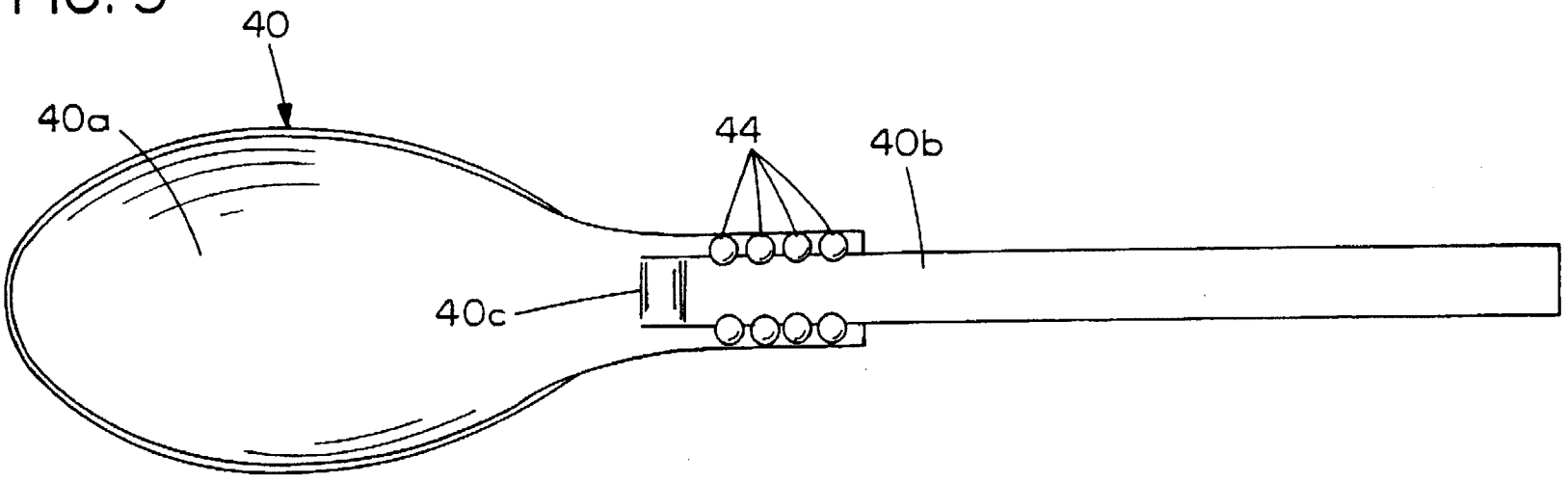
FIG. 9 is a top view of the utensil of FIG. 8 with the handle fully deployed so that the utensil is ready for use.
Figure 10:
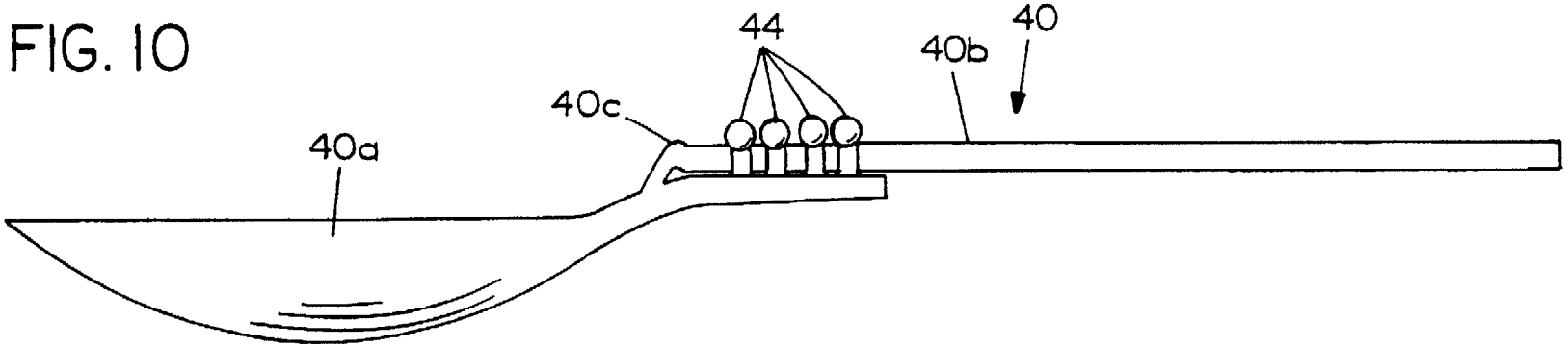
FIG. 10 is a partial enlarged side view of the utensil of FIGS. 8 and 9.

Refer now to FIGS. 8–10 which illustrate another form of utensil in accordance with the invention. In this case the utensil 40 includes a functional end portion 40a, namely a spoon in this case, and handle portion 40b connected by means of a living hinge 40c. Beneath the portion of the handle 40b adjacent the hinge 40c is an abutment 42 which is integral with the spoon portion 40a. The abutment 42 includes two rows of laterally spaced apart, longitudinally aligned, upwardly extending catch elements 44 that serve as snap fasteners to engage the side edges of the handle 40b when the handle is folded down to securely retain it in position for use adjacent to the abutment 42 as shown in FIGS. 9 and 10. When the utensil 40 is to be folded for storage, the handle portion 40b can be raised from the solid line position of FIG. 9 and freed from the catch elements 44 and then refolded to the dotted line position of FIG. 8, allowing the utensil 40 to be stored for reuse. The abutment 42 has a dual purpose. The abutment 42 strengthens the joint between the spoon and the handle. As previously described, when the utensil 40 is folded up, the abutment 42 also projects into the retaining slot 32a of the cover 14 for holding the utensil 40 in place inside the cover 14.

Many variations of the present invention within the scope of the appended claims will be apparent to those skilled in the art once the principles described herein are understood.

What is claimed is:

1. A food package comprising, a can body containing a quantity of food, said can body including a side wall, a connected bottom wall and a lid at the top to provide a hermetic seal for preventing contamination of the food contained in the can, a handle connected to the lid and extending from the lid to enable the lid to be fractured and torn away from the top portion of the container to expose the food contained therein, a removable cover replaceably secured to the can to enclose the top of the can enclosing both the lid and the handle and to provide a storage compartment between the lid and the cover and seal partially eaten food, a folded eating utensil contained in the storage compartment in a position between the removable cover and the lid of the can, said utensil having a functional end portion and a handle with a connection therebetween for enabling the utensil to be folded for storage in the compartment, said utensil being connected to the inside of the cover such that the removal of the cover will also remove the utensil to thereby expose the lid and handle so that the utensil is out of the way when the handle on the lid is to be gasped for tearing away the lid from the can body, said cover having utensil retaining slot means molded on an inside surface of the cover in spaced apart relationship corresponding to the distance between ends of the utensil when in a folded condition so that the folded utensil can be slid into place within the slot means or snapped into the slot means when in a folded condition, such that when the food is to be consumed, the removal of the cover carries the utensil with the cover to expose the lid and handle thereby enabling the handle to be gasped manually to tear off the lid and the utensil then removed from its concealed position inside the cover for use and later replaced within the slot means on the inside of the cover before the cover is replaced on the can body to (a) keep the utensil clean (b) keep the utensil out of the food and (c) keep the food sealed until any remaining food is eaten.

2. The food package of claim 1 wherein said connection of the utensil is a living hinge and a locking means is provided for holding the handle in an unfolded position wherein the handle extends away from the functional end portion of the utensil.

3. The food package of claim 2 wherein said looking means has at least one catch element operatively associated between the handle and the functional end of the utensil for enabling the handle to be locked into an extended position away from the functional end of the utensil.

4. The food package of claim 1 wherein the utensil includes a means for holding the handle in an extended position projecting away from the functional end portion of the utensil and the means comprises a locking sleeve slidably mounted upon the utensil for sliding over and locking said connection between the handle and the functional end of the utensil.

5. The food package of claim 1 wherein the functional end portion of the utensil includes an integral abutment having a free end and a connected base, wherein said connection is a living hinge provided between the functional end of the spoon and the handle at the base of the abutment so that the abutment supports and positions the handle when the handle is unfolded to an extended position ready for use, and wherein said utensil further includes a locking means as a part of the utensil for securing the handle adjacent to the abutment in the extended position.

6. The food package of claim 5 wherein the locking means is a locking sleeve slidably engaged upon the utensil to extend over the handle and the abutment.

7. The food package of claim 1 wherein the utensil retaining slot means is on the cover and includes a pair of diametrically opposed retaining slots for the utensil, and the utensil has a first portion at one end thereof adapted to extend into one retaining slot and a second portion thereof adjacent said connection for extending into the other retaining slot.

8. The food package of claim 7 wherein the second portion of the utensil adjacent to said connection is an abutment and the abutment has a free end portion that extends into one of the retaining slots.

9. The food package of claim 8 wherein said connection is a living hinge, and the abutment has a base portion positioned proximate to the living hinge, such that the abutment serves a dual purpose of retaining the utensil in one of the retaining slots when the utensil is in storage and also serves as a support for positioning and retaining the handle in a fixed position when the handle is unfolded to an extended ready-to-use position.

10. The food package of claim 9 wherein said utensil further includes a locking sleeve that is slidable upon the utensil to a position over said connection for holding the handle in the extended position.

11. The package of claim 9 wherein said utensil further includes a locking means operatively associated with the handle for releasably locking the handle in the extended position proximate to the abutment.

* * * * *